United States Patent [19]

Yamada

[11] Patent Number: 4,604,137

[45] Date of Patent: Aug. 5, 1986

[54] METHOD AND APPARATUS FOR CONTROLLED MELT REFINING

[75] Inventor: Katsuhiko Yamada, Hyogo, Japan

[73] Assignee: Sumitomo Electric Industries, Ltd., Osaka, Japan

[21] Appl. No.: 777,136

[22] Filed: Sep. 18, 1985

[30] Foreign Application Priority Data

Sep. 18, 1984 [JP] Japan ..... 59-196191

[51] Int. Cl.[4] ..... C21C 5/52

[52] U.S. Cl. ..... 75/49

[58] Field of Search ..... 75/49

[56] References Cited

U.S. PATENT DOCUMENTS

| | | | |
|---|---|---|---|
| 3,574,603 | 4/1971 | Rassenfoss | 75/129 |
| 3,980,469 | 9/1976 | Forster | 75/49 |
| 4,036,635 | 7/1977 | Klapdar | 75/49 |
| 4,200,452 | 4/1980 | Savov | 75/49 |

*Primary Examiner*—Peter D. Rosenberg

*Attorney, Agent, or Firm*—Sughrue, Mion, Zinn, Macpeak, and Seas

[57] ABSTRACT

A controlled melt refining method is provided that ensures rapid and consistent refining by controlling the gas hold-up (ΔH/H), as an index for the intensity of boiling, at a predetermined value in the range of 0.1–0.5. The method comprises (a) covering the surface of a semi-killed molten steel in a ladle with a basic slag which either is non-oxidizing or contains not more than 5% of FeO; (b) maintaining the pressure of the atmosphere above the melt in the range of 30–150 Torr; (c) blowing an inert gas into the ladle from the bottom; and (d) maintaining the height of the boiling melt in terms of gas hold-up (ΔH/H) within the range of 0.1–0.5 by controlling the pressure at which the inert gas is blown and/or by adjusting a vacuum exhaust valve, ΔH being the difference in height between the surface of the boiling melt and a quiet melt, and H being the height of the quiet melt. The present invention also comprises an apparatus for refining molten steel in accordance with the above method.

5 Claims, 7 Drawing Figures

METHOD AND APPARATUS FOR CONTROLLED MELT REFINING

FIELD OF THE INVENTION

The present invention relates to a method and apparatus for performing controlled refining of molten steel by rapidly and accurately reducing the amounts of oxygen and nonmetallic inclusions that are detrimental to such steel properties as toughness, fatigue resistance and cold workability.

BACKGROUND OF THE INVENTION

In crder to produce steels of high quality, it is important to properly control the amount and form of nonmetallic inclusions by reducing the oxygen content in molten steel and separating and removing nonmetallic inclusions suspended in the melt.

Various refining methods have been proposed or commercialized for performing efficient deoxidation and removal of nonmetallic inclusions in the outside of the furnace. Basically, these methods perform preliminary refining in the melting furnace and transfer the melt to an external ladle for effecting the final refining. The present invention is an improvement of this basic method for performing the final stage of refining in equipment outside the melting furnace.

The operating principles and features of several of the conventional methods for performing the final stage of refining in equipment outside the furnace are hereunder described.

(1) Vacuum degassing

This method is most extensively used for refining speciality steels; its operating principle is to cause turbulence in an unkilled or semi-killed molten steel under a high degree of vacuum, causing sufficiently vigorous CO formation to remove hydrogen and oxygen from the melt.

The treated steel has very low hydrogen and oxygen content and fairly small amounts of nonmetallic inclusions. However, in this method, the slag layer must be eliminated in order to expose the melt directly to the vacuum, and the particles of nonmetallic inclusions suspended in the melt are not adsorbed on the slag and hence cannot be completely eliminated from the melt. Another problem with this method is that in order to create a high degree of vacuum ($\simeq$1 Torr), a large-capacity steam ejector must be used, which only results in an extremely high energy cost.

(2) The ladle furnace method

This method is principally designed for removal of oxygen and nonmetallic inclusions; it uses a ladle having a construction similar to that of an Heroult electric furnace and supplies a carbide slag during the refining period. For accelerated reducing reaction, gas bubbling is effected by blowing an inert gas into the ladle from the bottom in an amount that will not instabilize the arc.

This method ensures the production of steels having the necessary high quality, but it has two serious defects: firstly, it requires a considerably high financial investment; and secondly, because of low reaction rates, a prolonged treatment is necessay and this causes an appreciably increased operating cost including such factors as electricity for heating, refractories and electrode rods.

(3) Gas bubbling

The principal object of this method is to provide a uniform temperature distribution and remove any nonmetallic inclusions; the operating principle is to blow an inert gas into an already killed molten stell through a gas-permeable refractory, causing boil to an extent sufficient to cause the suspended nonmetallic inclusions to be adsorbed on the slag for removal from the melt.

This method involves simple procedures and requires low operating costs, but is not capable of achieving satisfactory deoxidation and removal of non-metallic inclusions. Two primary reasons are: the bubbles of inert gas blown into the melt are not capable of inducing as strong CO boil as is caused by the vacuum degassing method (1); and the molten steel is oxidized by the ambient air.

(4) Ca alloy blowing

The three objectives of this method are deoxidation, desulfurization and removal of nonmetallic inclusions, and the operating principle is to blow a Ca alloy powder as carried by an inert gas directly into a molten steel through a refractory pipe while the surface of the melt is covered with a non-oxidizing basic slag.

This method provides steels of high quality with high reaction rates and its capital cost is not very high. However, the use of large volumes of expensive Ca alloys and argon gas not only increases the operating cost but also makes this method unfit for those types of steel which should not contain Ca or Al.

The conventional methods described above have their own merits and demerits and steels of high quality cannot be obtained without increasing either capital or operating costs.

The conditions that ensure effective removal of oxygen and nonmetallic inclusions from molten steel can be summarized as follows:

(a) The melt must be subjected to the proper degree of preliminary refining depending on the refining method, working period and the desired level of refining;

(b) In order to increase the rate of deoxidation and removal of nonmetallic inclusions, agitation of the melt is essential and CO boil as strong as that which is caused by vacuum degassing is desirable;

(c) In order to remove nonmetallic inclusions by adsorption, the melt should be covered with a non-oxidizing slag which should be basic if desulfurization and prevention of resulfurization are also to be realized;

(d) The melt and slag should be perfectly protected against oxidation during the refining period and the FeO content in the slag is desirably not more than 1%.

The present inventors previously made close observation of the effects of ambient pressure on the phenomenon of boiling that occurs in the gas bubbling method and discovered the following important facts on the basis of the analyses of the boiling reaction. Basically, the inventors found that effective deoxidation and removal of nonmetallic inclusions can be realized by properly controlling such factors as the initial conditions of the melt, slag composition, its properties, intensity of bubbling and the ambient pressure (of the atmosphere in the ladle). The conditions to be met are: (1) the gas bubbling method is used as the basic approach; (2) this method is operated at very low pressure close to vacuum so as to induce CO boil which is as strong as that caused by degassing in vacuum and to ensure a nonoxidizing atmosphere; (3) for effective removal of nonmetallic inclusions, a semi-killed molten steel is subjected to boiling treatment in the presence of a proper slag; and (4) in order to significantly reduce the operating cost, the necessary minimum degree of vacuum is to be obtained by an inexpensive vacuum pump, for example, a water-sealed vacuum pump. An invention has already been accomplished on the basis of this approach and a patent was applied for it under Japanese Patent Application No. 75574/1981 (Unexamined Published Japanese Patent Application No. 192214/1982).

SUMMARY OF THE INVENTION

The invention disclosed in Unexamined Published Japanese Patent Application No. 192214/1982 relates in one aspect to a method wherein a semi-killed molten steel in a ladle, the surface of said melt being covered with a slag which either is non-oxidizing or has an FeO content of 5% or less, is subjected to gas bubbling for a period of 3 minutes or longer by blowing an inert gas into the ladle from the bottom while the pressure of the atmosphere above the melt is held at 30–150 Torr. In another aspect, the invention relates to an apparatus for implementing this method. By later studies, the present inventors have found that if gas bubbling is performed with the gas holdup ($\Delta H/H$) indicative of the level of the surface of the boiling melt being controlled at a predetermined value in the range of 0.1–0.5, rapid and consistent refining reaction rates can be obtained.

Therefore, in accordance with one aspect of the present invention, a controlled melt refining method is provided that ensures rapid and consistent refining by controlling the gas holdup ($\Delta H/H$), as an index for the intensity of boiling, at a predetermined value in the range of 0.1–0.5.

In accordance with another aspect of the present invention, a controlled melt refining method is provided wherein the gas holdup ($\Delta H/H$) is retained at a predetermined value in the range of 0.1–0.5 while the CO concentration and flow rate of the gas being evacuated are continuously measured so as to monitor the progress of deoxidation by a computer and provide for online determination of the end point of the refining.

In accordance with a third aspect of the present invention, an apparatus for use in the practice of the first or second method is provided. It comprises a ladle that has airtight side walls which are provided with a vacuum cover on top and bottom so as to render the interior of the ladle airtight, said ladle having an inert gas blowing unit in the bottom; a water sealed vacuum pump that is connected to the top vacuum cover of the ladle via an exhaust duct; a filter type particulate collector provided upstream of said vacuum pump; a sealant controller that is provided downstream of said vacuum pump and which causes the sealing water to be circulated and held at temperatures not higher than 30° C.; and a gas holdup control system that includes a unit for detecting the level of the surface of a boiling melt and which is composed of a controller which, in response to an output signal from said detector, performs automatic adjustment of a gas blow pressure control valve and/or a vacuum exhaust valve. The present invention also provides a melt refining apparatus that has additional units for the apparatus described above.

DETAILED DESCRIPTION OF THE INVENTION

The present invention is hereunder described in detail by reference to the accompanying drawings.

Figure 1:
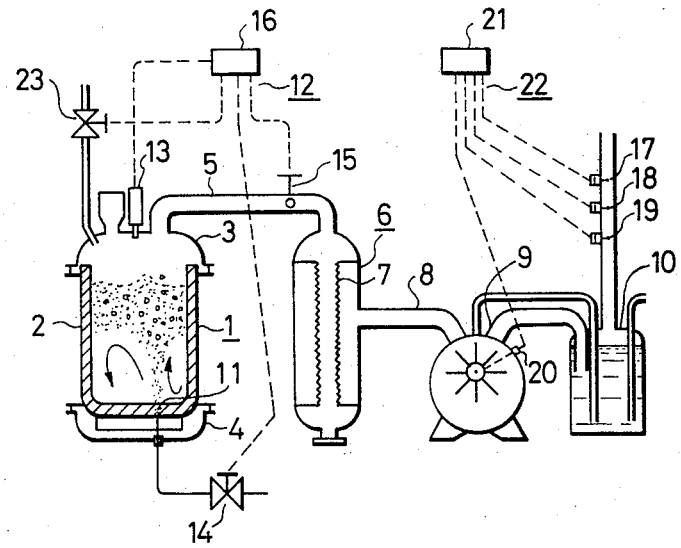
FIG. 1 is a schematic diagram of the apparatus of the present invention in accordance with one embodiment.

FIG. 1 is a side elevational section of one embodiment of the apparatus of the present invention. In FIG. 1, a ladle generally indicated at 1 has a porous plug 11 in the bottom that is made of a gas-permeable refractory and through which an inert gas is to be blown into the ladle. The ladle 1 has steel side walls 2 which are airtight and provided with an upper airtight cover 3 and a lower airtight cover 4 so as to render the interior of the ladle completely airtight.

The upper airtight cover 3 is connected to an exhaust duct 5 which is further connected to a filter type particulate collector 6. The particulate collector 6 has a filter medium 7 in the inside through which the gas coming from the ladle is passed for removal of any particulate matter.

The dust-free gas passes through an exhaust duct 8 to enter a water-sealed vacuum pump 9. The ultimate pressures achieved by water-sealed vacuum pumps are not very low but they are suitable for creating pressure between 30 and 150 Torr. In addition, they can be operated at low cost and provide for easy maintenance.

A sealant control unit 10 is provided downstream of the vacuum pump 9. The control unit 10 establishes circulation of the sealing water in the pump 9 and holds it at temperatures not higher than 30° C.

The upper airtight cover 3 is provided with a gas holdup control system 12 that includes a level sensor 13 for continuous measurement of the level of the surface of a boiling melt and a controller 16 which, in response to an output signal from the level sensor, controls a valve 14 for adjusting the pressure of gas being blown into the ladle through the porous plug 11, vacuum exhaust valve 15 provided midway of the duct 5, and an inert gas blow valve 23. Within a duct downstream of the vaccum pump 9, there are provided a CO concentration meter 17, a thermometer 18, and anenometer 19 or a vacuum pump tachometer 20 as an alternative to the anenometer 19. Signals from the respective sensors are fed into a CPU 21 which provides for continuous measurement of the total CO in the gas from the ladle and calculates continuously the amount of oxygen being removed from the melt during the operation of the apparatus. The devices 17, 18, 19 (20) and CPU 21 make up a deoxidization monitor system that is generally indicated at 22 in FIG. 1.

The method of the present invention for performing controlled purification of a molten stell by the apparatus shown in FIG. 1 is hereunder described.

First, a molten steel that has been preliminarily deoxidized with Mn or Si in a melting furnace (e.g., electric arc furnace) is tapped into the ladle 1 together with a non-oxidizing and basic slag or contains not more than 5% of FeO.

The ladle 1 is placed on the lower airtight cover 4 and the upper airtight cover 3 is then set on the ladle 1. The water-sealed vacuum pump 9 is actuated to evacuate air from the ladle 1 while it is passed through the particulate collector 6 for removal of particulate matter.

While the pressure in the ladle 1 is held at between 30 and 150 Torr. an inert gas such as $N_2$ or Ar gas is blown into the molten steel through the porous plug 11 in the bottom of the ladle, and by so doing, strong gas bubbling (or boiling) is performed for at least 3 minutes at the ambient pressure of 30–150 Torr.

At ambient pressures higher than 200 Torr turbulence is caused by the bubbling, but when the pressure becomes 200 Torr or below, there occurs a sudden change from simple turbulence to a strong boiling phenomenon. As a result, the entire surface of the melt and slag is covered with a caramel-like layer of fine gas bubbles about several hundred millimeters high. This "boiling" is continued for at least three minutes during which time fine adjustment of the components of the steel is effected at suitable occasions.

The rate at which the refining reaction proceeds depends on the intensity of boiling, and needless to say, the stronger the boiling, the shorter the necessary refining period, which presents distinct advantages because of reduced heat loss and refractory loss, as well as increased productivity.

The above discussion indicates the technical importance of treating the molten metal within a limited time period while the surface of the boiling melt is held at a predetermined high level. The level sensor 13 is used to achieve this purpose. In response to a level signal from this sensor 13, the gas holdup control system 12 is actuated and the controller 16 performs proper adjustment of the blow gas pressure valve 14 and vacuum exhaust valve 15. If, for example, the level of the surface of the boiling melt is low, the pressure valve 14 is immediately adjusted so that an increased amount of inert gas is permitted to enter the ladle. If, on the other hand, a predetermined upper limit for the level of the surface of the boiling melt is exceeded, the opening of each of the valves 14 and 15 is reduced so as to lower the level of the surface of the boiling melt. If the boiling level is still higher than the upper limit, the valves are completely constricted and, at the same time, a large volume of inert gas is momentarily blown into the vacuum above the melt through a valve 23 so as to automatically reduce the intensity of the boiling and calm down the melt.

The term "gas holdup" is defined as the percentage residence or volume of gas bubbles with in liquid and is expressed by the volume of gas divided by that of the liquid taken independently (gas/liquid) or in combination with the gas (gas/gas+liquid). The factor "gas holdup" is used in the present invention as a measure for the intensity of gas-liquid reaction and expressed in terms of $\Delta H/H$ wherein H is the height of the surface of a quiet molten steel and $\Delta H$ is the difference in height between the surface of a boiling melt and this quiet melt.

The level sensor 13 detects both H, the height of the surface of a quite molten steel (or its depth) just before boiling takes place, and H', the level of the surface of a boiling melt. After confirming that H' is lower than the value permitted by safety requirements, the sensor calculates $H'-H=\Delta H$ and delivers a control signal for holding $\Delta H/H$ at a predetermined value.

The level of the surface of the boiling melt is determined by the pressure of the inert gas being blown (its flow rate), the concentration of CO in the melt, the intensity of refining reaction and the pressure of the atmosphere in the ladle.

The deoxidation monitor system 22 comprising CO concentration meter 17 and any other necessary detectors plus CPU 21 is provided for monitoring the process and end point of the refining operation. When the rate of deoxidation (ppm/min) is lowered to a predetermined value, CPU 21 makes necessary calculations on the basis of comparison with internally stored data, and if it finds that the refining operation has reached the end point, the CPU delivers a signal indicating that fact.

As described in the foregoing pages, the present invention enables effective removal of oxygen and nonmetallic inclusions from molten steel by means of the bubbling of an inert gas in vacuum. When satisfactory removal of oxygen and nonmetallic inclusions has been effected, the vacuum pump 9 is turned off and the supply of inert gas is stopped and the upper airtight cover 3 is removed from the ladle 1 in preparation for subsequent casting operations.

The semi-killed steel that is obtained by preliminary deoxidatin in the melting furnace and which is used as the starting material in the present invention preferably has an oxygen content of $100\pm30$ ppm. There are two reasons for using such semi-killed steel: a non-oxidizing slag can be rapidly formed within the furnace, and CO boil can be induced as a result of evacuating the ladle. An unkilled steel is not suitable for this since it requires an excessively prolonged refining operation within the ladle.

A non-oxidizing slag is used in the present invention in order to prevent the molten steel from being oxidied by th slag during the refining. If the FeO content of the slag is 5% or less, rapid reduction of FeO usually occurs in the early stage of refining in the ladle and an FeO level of 1% or below is obtained. The slag must also be basic in order to avoid the occurrence of rephosphorization and resulfurization during the refining.

The pressure of the atmosphere above the molten steel is limited to be within the range of 30–150 Torr. If the pressure is higher than 150 Torr, the rate of deoxidation is reduced and a prolonged and, hence, costly refining becomes necessary to achieve the intended deoxidation. Generally speaking, higher deoxidation rates are obtained with lower pressures, but water-sealed pumps are unable to produce pressures lower than 30 Torr. Such low pressures may be created by using other vacuum systems such as steam ejectors but then they consume so much energy to operate that one of the important objects of the present invention, that is, cost reduction, cannot be realized.

As just mentioned above, higher deoxidation rates can be obtained by reducing the pressure in the ladle, but in the presence of slag, the effect of pressures in the ladle on the deoxidation rate is not as great in the lower pressure range as in the higher range, and no significant increase in the deoxidation can be attained even if the pressure in the ladle is reduced below 30 Torr. This is another reason why the pressure of the atmosphere in the ladle should not be lower than 30 Torr.

Examples of the inert gas used in the present invention are $N_2$, Ar and hydrocarbon gases. They are used to produce such effects as physical agitation and separation of contained gases without causing any chemical reactions that will be detrimental to the melt and slag.

The treatment by gas bubbling is continued for at least three minutes because with the usual deoxidation rate, which is approximately 10 ppm/min, it is difficult to obtain the desired degree of deoxidation in a period shorter than 3 minutes.

In the apparatus of the present invention, the ladle has airtight side walls. If the volume of the space to be evacuated is small, the desired degree of vacuum can be obtained within a short period of time and the necessary period of purification is shortened. These objects can be best achieved by constructing a ladle that is by itself a vacuum chamber.

A water-sealed pump is used as an evacuation unit in the apparatus of the present invention. Mechanical vacuum pumps can be operated at much lower cost than steam ejectors, but if they are used in the purification of molten steel, vary high maintenace costs are incurred because of the generation of much particulate matter and heat. The ultimate pressures of water-sealed vacuum pumps are not very high but of the various types of mechanical vacuum pumps known today, they involve the lowest maintenance costs of all.

Needless to say, other mechanical pumps may be used if the level of maintenance costs involved does not compromise the objects of the present invention.

A particulate filter is provided upstream of the vacuum pump. The filter is necessary for ensuring good maintenance of the vacuum pump and has the function of preventing the contamination of the sealing water by particulate matter. Since the apparatus of the invention is operating under vaccum, a particulate collector depending on electrostatic adsorption is not suitable and a filter may be used with satisfactory results although it may cause some degree of pressure drop.

A sealant controller is provided downstream of the vacuum so as to establish circulation of the sealing water and to hold it at temperatures of 30° C. or below. If the temperature of the sealing water is increased, a rapid increase in the vapor pressure degrades the ultimate pressure of the vacuum pump. In order to avoid this problem, the pump must always be supplied with sealing water of low temperatures ($\leqq$30° C.).

The gas holdup control system is incorporated in order not only to maintain the maximum permissible height of the boiling melt but also to avoid the occurrence of an overflowing melt or a sudden boiling due to the presence of moisture in the refractory of an incompletely dried ladle.

The deoxidation monitor system is provided in order to ensure economic operations by ending the deoxidation at the right point of time.

The operation of the present invention proceeds as follows.

In the melting furnace, a molten high-carbon steel is preliminary deoxidized to an oxygen content of 100±30 ppm in the presence of a non-oxidizing and basic slag, and thereafter, the melt and slag are tapped into the ladle 1 shown in FIG. 1.

The ladle is rendered airtight as soon as possible and the water-sealed vacuum pump 9 is actuated to displace the atmosphere above the melt while an argon gas is blown into the ladle from the bottom.

Figure 2:
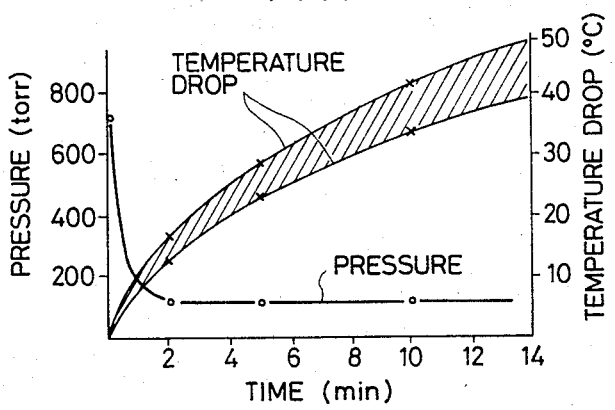
FIG. 2 shows time-dependent profiles of the pressure of the atmosphere in the ladle and the drop of the temperature of melt in accordance with the present invention.

The time-dependent profiles of the pressure in the ladle and drop in the temperature of the melt are shown in FIG. 2, from which one can see that as soon as the vacuum pump gets started, the pressure in the ladle is decreased rapidly and levels off in about 2 minutes.

Figure 3:
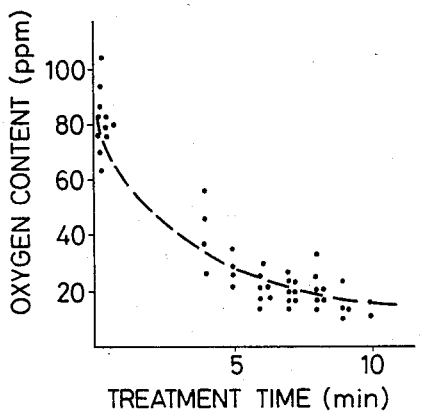
FIG. 3 shows the relationship between the bubbling period and the oxygen content of the melt in accordance with one embodiment of the method of the present invention.

The relationship between the bubbling period and the oxygen content of the melt is shown in FIG. 3.

When the pressure of the atmosphere above the melt in the ladle becomes 200 Torr or below, a strong boiling occurs to accelerate the removal of oxygen and nonmetallic inclusions. In accordance with the present invention, the height of the boiling melt is retained at a high level throughout the bubbling operation.

In terms of $\Delta H/H$, an optimum height for the boiling melt is 600 mm/1,800 mm=0.3 and with this value, the necessary refining of the melt is completed in 6 minutes. For the purposes of the present invention, $\Delta H/H$ may be within the range of 0.1 to 0.5.

The required period of the refining operation is proportional to the value of gas holdup.

Figure 4:
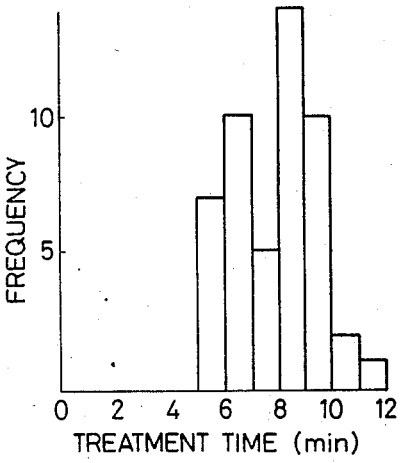
FIG. 4 is a histogram of the bubbling period necessary for the usual production of SWRA 82A, the grade of steel employed for piano wires.

FIG. 4 is a histogram of the bubbling period necessary for the usual production of SWRA 82A, the grade of steel used for piano wires. From this Figure, one can see that satisfactory refining is completed in about 10 minutes.

Figure 5:
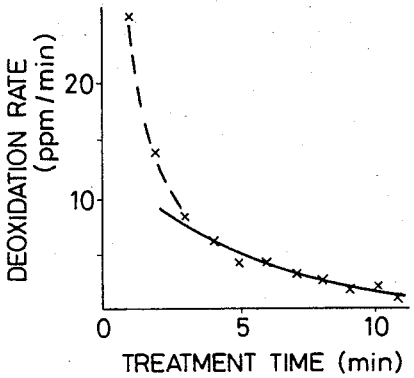
FIG. 5 is a readout of an online calculation of the deoxidation rate from the deoxidation monitor system 22, showing that the degree of deoxidation approaches the saturation level in about 10 minutes.

FIG. 5 is a readout of an online calculation of the deoxidation rate from the deoxidation monitor system; it shows that the degree of deoxidation approaches the saturation level in about 10 minutes.

Figure 6:
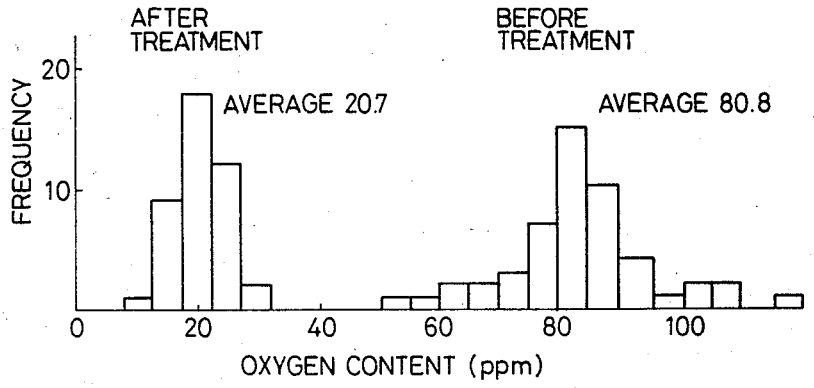
FIG. 6 shows histograms of oxygen content in the melt before and after treating the same grade of steel by the present invention.

FIG. 6 shows histograms of oxygen content in the melt before and after treatment by the present invention; the melt treated by the invention is highly deoxidized and the variance of oxygen content is very small.

Figure 7:
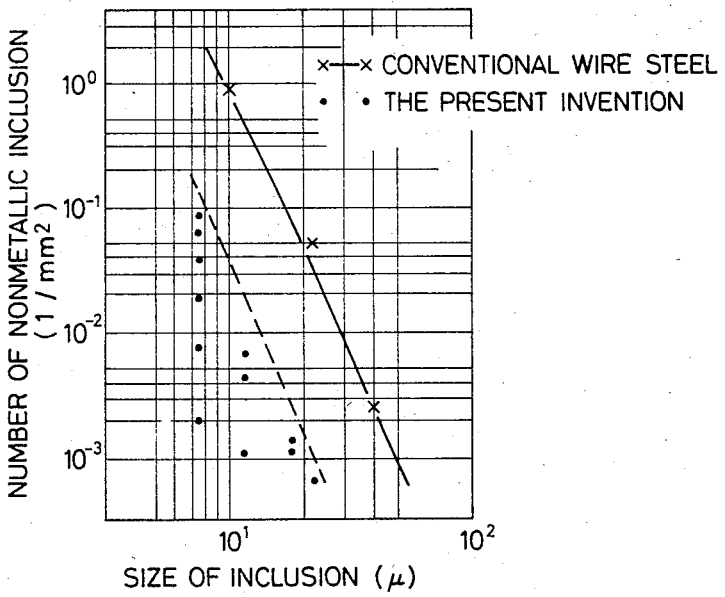
FIG. 7 shows the size distribution of non-metallic inclusions in SAE 9254, a wire steel, treated by the method of the present invention, as compared with data for the sample treated by the conventional atmospheric bubbling.

FIG. 7 shows the size distribution of non-metallic inclusions in SAE 9254, a wire steel, treated by the present invention, as compared with data for a sample treated by the conventional atmospheric bubbling. It can be readily seen that the present invention is highly effective for the purpose of refining steels.

In accordance with the first aspect of the present invention, the surface of semi-killed molten steel in the ladle is covered with a non-oxidizing ($FeO \leqq 5\%$) and basic slag, so any undesired oxidation, rephosphorization or resulfurization of the melt can be effectively prevented during the refining period while ensuring easy removal of nonmetallic inclusions by adsorption on the slag. The pressure of the atmosphere above the melt is held within the range of 30–150 Torr and gas bubbling is performed by blowing an inert gas into the ladle from the bottom for a period of at least 3 minutes. In order to provide the proper height of boilng melt, a sufficient amount of inert gas is blown rapidly so that a strong CO boil is induced and the melt is consistently kept under a highly boiling state throughout the refining until oxygen and nonmetallic inclusions are effectively removed from the melt in a fairly short period of time.

In accordance with the second aspect of the invention, the progress of deoxidation of the melt can be monitored with great ease.

In accordance with the third aspect of the invention, a gas holdup control system including a level sensor for detecting the height of the surface of the molten steel is incorporated in the refining apparatus, and this allows the refining operation to proceed consistently and be completed in a short period while ensuring utmost safety during the operation.

In accordance with the fourth aspect of the invention, the progress of refining can be monitored with a computer so that the operator is informed online of the end point of the refining of the melt. This will be of great help in increasing the efficiency of the refining operation of molten steel.

While the invention has been described in detail and with reference to specific embodiments thereof, it will be apparent to one skilled in the art that various changes and modification can be made therein without departing from the spirit and scope thereof.

What is claimed is:

1. A method of controlled melt refining comprising: (a) covering the surface of a semi-killed molten steel in a ladle with a basic slag which either is non-oxidizing or contains not more than 5% of FeO; (b) maintaining the pressure of the atmosphere above the melt in the range of 30–150 Torr; (c) blowing an inert gas into the ladle from the bottom; and (d) maintaining the height of the boiling melt in terms of gas holdup ($\Delta H/H$) within the range of 0.1–0.5 by controlling the pressure at which the inert gas is blown and/or by adjusting a vacuum exhaust valve, $\Delta H$ being the difference in height between the surface of the boiling melt and a quiet melt, and H being the height of the quiet melt.

2. A method of controlled melt refining comprising: (a) covering the surface of a semi-killed molten steel in a ladle with a basic slag which either is non-oxidizing or contains not more than 5% of FeO; (b) maintaining the pressure of the atmosphere above the melt in the range of 30–150 Torr; (c) blowing an inert gas into the ladle from the bottom; and (d) maintaining the height of the boiling melt in terms of gas holdup ($\Delta H/H$, wherein $\Delta H$ is the difference in height between the surface of the boiling melt and quiet melt, and H is the height of the quiet melt) being held within the range of 0.1–0.5 by controlling the pressure at which the inert gas is blown and/or by adjusting a vacuum exhaust valve;

wherein the CO concentration and flow rate of the gas under evacuation is continuously measured and processed by a computer so as to monitor the progress of deoxidation of the melt and to make online determination of the end point of the refining operation.

3. An apparatus for the refining of a molten steel comprising a ladle having airtight side walls which are provided with a vacuum cover on top and bottom so as to render the interior of the ladle airtight, said ladle having an inert gas blowing unit in the bottom; a water sealed vacuum pump that is connected to the top vacuum cover of the ladle via an exhaust duct; a filter type particulate collector provided upstream of said vacuum pump a sealant controller that is provided downstream of said vacuum pump and which causes the sealing water to be circulated and held at temperatures hot higher than 30° C.; and a gas holdup control system that includes a level sensor for detecting the level of the surface of a boiling melt and which is composed of a controller which, in response to an output signal from said level sensor, performs automatic adjustment of a gas blow control valve and/or a vacuum exhaust valve.

4. An apparatus according to claim 3 wherein the gas holdup control system further includes a unit that enables a large amount of inert gas to be blown momentarily to top of the melt.

5. An apparatus according to claim 3 or 4 which further includes a deoxidation monitor system that is composed of a central processing unit plus at least a CO concentration meter and an anemometer and/or a vacuum pump tachometer which are provided in a duct downstream of the vacuum pump.

* * * * *